United States Patent [19]

Langowski

[11] 4,304,433

[45] Dec. 8, 1981

[54] PIPE GRIPPING HEAD

[75] Inventor: Faustyn C. Langowski, Georgetown, Tex.

[73] Assignee: BJ-Hughes Inc., Houston, Tex.

[21] Appl. No.: 130,761

[22] Filed: Mar. 17, 1980

[51] Int. Cl.[3] ..... B66C 1/00

[52] U.S. Cl. ..... 294/106; 414/22

[58] Field of Search ..... 294/102 A, 88, 90, 116, 294/106, 94, 93, 97, 103, 104, 115; 414/22

[56] References Cited

U.S. PATENT DOCUMENTS 4,013,178 3/1977 Brown ..... 294/102 A 4,185,866 1/1980 Wittwer ..... 294/88

*Primary Examiner*—James B. Marbert

*Attorney, Agent, or Firm*—Robert A. Felsman

[57] ABSTRACT

A pipe gripping head especially suitable for use with pipe handling apparatus in earth drilling operations. The pipe gripping head includes a pair of jaws operably pivotable between an open and a closed locked position which does not rely on pneumatic or hydraulic pressure to maintain the jaws in the closed position.

5 Claims, 3 Drawing Figures

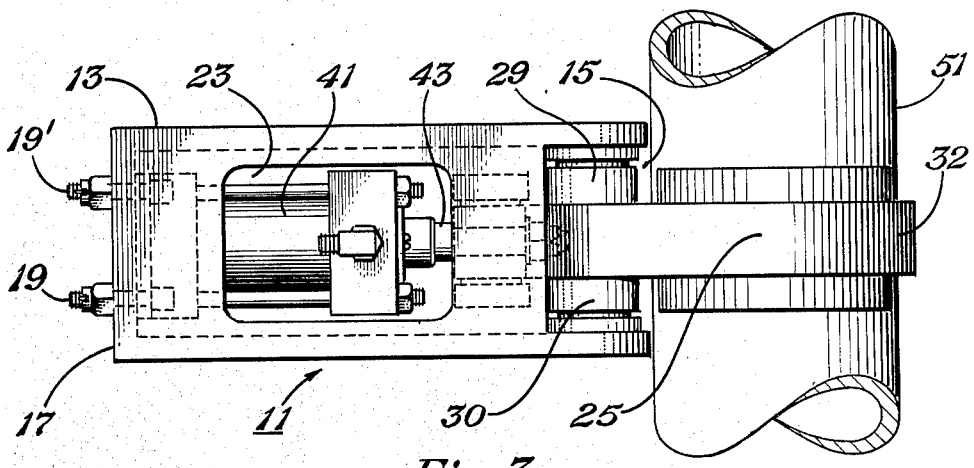
Fig. 3
Fig. 2
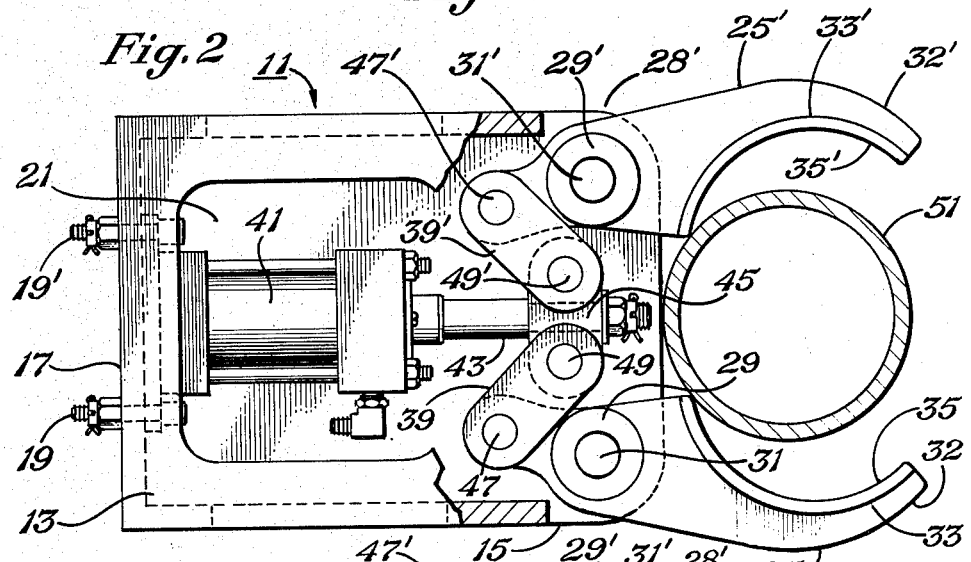
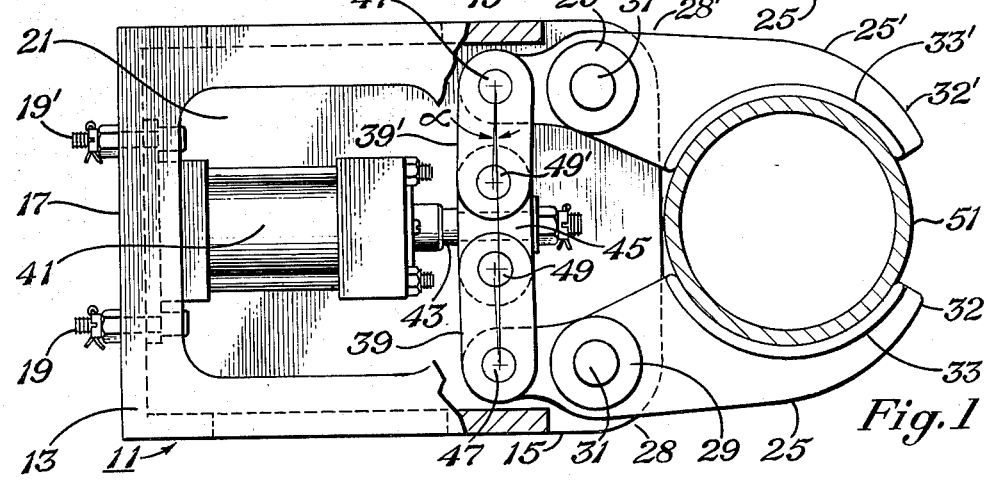
Fig. 1

PIPE GRIPPING HEAD

BACKGROUND OF THE INVENTION

1. Field of the Invention

This invention relates in general to earth drilling operations, and in particular, to a head used for grasping and handling pipe.

2. Description of the Prior Art

In earth drilling operations, it becomes necessary at times to transfer stands of pipe including drill pipe tubing and collars between the rotary table and setback or racking area. Because of the large weight of pipe stands, it has been found advantageous to use mechanical devices to transfer pipe between the rotary and the racking area. Mechanical systems are also utilized to handle and rack marine riser pipe used in drilling and producing offshore wells. Mechanical systems are safer, reduce crew fatigue, and allow more positive control. In addition, the transfer time can be decreased, thereby reducing trip time to increase efficiency. As a result, pipe handling systems, including gripping heads have been available for a number of years.

U.S. Pat. No. 3,561,811, issued Feb. 9, 1971, to J. W. Turner, Jr., "Well Pipe Racker", discloses pipe handling equipment including a hook or claw and supporting slide which are operated by fluid pressure to engage drill pipe.

U.S. Pat. No. 4,030,746, issued June 21, 1977, to F. C. Langowski, "Pipe Handling Head", shows a head used to grasp and guide a length of pipe. A hydraulic piston-cylinder arrangement serves to open and close the head.

In the pending application of Paul S. Putnam, et al, entitled "Mechanized Stand Handling Apparatus for Drilling Rigs", Ser. No. 833,145, filed Sep. 14, 1977, a pipe gripping head is shown on an arm driven by linkages, gears, cylinders, and combinations thereof.

SUMMARY OF THE INVENTION

It is a general object of this invention to provide a pipe gripping head which is simple, dependable and which remains in a locked position in the event fluid pressure is lost.

Another object of the invention is to utilize a single pneumatic or hydraulic (i.e. fluid) cylinder to actuate the head, thereby increasing reliability and decreasing required maintenance.

Another object of this invention is to utilize fluid pressure, to unlock the jaws of the gripping head and not to use said pressure to provide gripping force when the jaws are closed on a pipe.

A further object of this invention is to provide a head of convenient size which will fit into tight spaces.

The pipe gripping head of this invention comprises a frame adapted to be secured to pipe handling apparatus and a pair of opposed arms each being pivotally secured to the frame. Jaw means on one end of the arms engage and grip the pipe. An actuating linkage is connected to each arm at the end opposite from the jaws. Biasing means is connected to the actuation linkage for movement between a locking position to close the jaws on the pipe and on unlocked position to open the jaws.

In a preferred embodiment, the biasing means includes a single fluid cylinder having a housing carried by the frame and an output shaft movable between an extended position and a retracted position. A connection bar is secured to the output shaft of the fluid cylinder and is pivotally connected to the actuation linkage to rigidly align the actuation linkage and close the jaw means when the output shaft is retracted and to pull the actuation linkage and arms to open the jaw means when the output shaft is extended.

BRIEF DESCRIPTION OF THE DRAWINGS

FIG. 1 is a top view of the pipe gripping head of this invention in the closed position with a portion of the frame cut away on the top.

FIG. 2 is a top view of the pipe gripping head similar to FIG. 1 except in the open position.

FIG. 3 is a side view of the pipe gripping head showing the jaws engaging a section of pipe.

DESCRIPTION OF THE PREFERRED EMBODIMENT

The pipe gripping head 11 of the present invention has a frame 13 adapted to be secured to pipe handling apparatus. The frame can be a box like structure as in FIG. 1 with an open end 15 and a closed end 17. Closed end 17 is connected to any of a number of existing pipe handling apparatus known in the art and not a part of this invention. A suitable apparatus is shown, for example, in our co-pending United States application, entitled "PIPE MANIPULATOR", by Roger Smith Jr., and Faustyn C. Langowski, filed concurrently herewith, the disclosure of which is hereby incorporated by reference. Attaching means, in this case, bolts 19, 19' connect the frame 13 to the pipe handling apparatus. Openings 21, 23 are provided through the frame surface for ease of maintenance. A pair of opposed arms 25, 25' are each pivotally secured to the frame 13, preferably at an intermediate region 28, 28'. This is accomplished by suitably placing four bushings 29, 29', 30, 30', within the frame 13, such that each opposed arm 25, 25' is between two bushings, 29, 29', and 30, 30' respectively and then placing pivot pins 31, 31' between opposing bushings through each opposed arm.

The opposed arms 25, 25' each having jaw means including jaw ends 32, 32' with a gripper surface 33, 33' form a concave arc with respect to the like surface on the opposed arm. Removable inserts 35, 35' shown in FIG. 2, attach to the gripper surfaces 33, 33' to accommodate different diameter pipes.

An actuation linkage means comprising a pair of actuation links 39, 39' each have one end pivotally secured to a respective opposed arm 25, 25' at the end opposite the jaw means by a link pin 47, 47'. Biasing means are provided to move the actuating links 39, 39' and include a fluid cylinder 41 with an output shaft 43 and connection bar 45. Fluid cylinder 41 is a double-acting pneumatic or hydraulic actuated cylinder mounted by a suitable housing near the closed end 17 of frame 13. The cylinder 41 is so positioned that output shaft 43 protrudes a small distance from the cylinder end distal the closed frame end 17 when retracted as in FIG. 1 and extends in a direction away from and perpendicular to the closed frame end 17 when the cylinder 41 is actuated as in FIG. 2.

Connection bar 45 is rigidly attached to output shaft 43 near the end of the shaft distal the cylinder 41. The connection bar longitudinal axis is perpendicular to the longitudinal axis of the output shaft 43. Each end of connection bar 45 is connected to the proximate end of one of the actuation links 39, 39' by link pins 49, 49'. Link pins 47, 47' and 49, 49' are rigidly attached to the respective actuation link 39, 39' but are freely rotatable with respect to the opposed arm 25, 25' or connection bar 45.

In operation, cylinder 41 is actuated, as by opening a valve (not shown) and pressure causes output shaft 43 to be fully extended as in FIG. 2. As the output shaft 43 is extended, the connection bar 45 and hence the ends of actuation links 39, 39' attached thereto are urged toward the open end 15 of the frame 13. The opposite ends of the actuation links are constrained to travel in an arc about pivot pins 31, 31' of the opposed arms 25, 25' thus urging the opposed arms 25, 25' to pivot about pivot pins 31, 31' in a counterclockwise direction. The pivoting motion causes the jaw ends 32, 32' to open for receiving a pipe.

Conversely, reversing pressure in cylinder 41 causes output shaft 43 to be fully retracted. The connection bar 45 and ends of actuation links 39, 39' attached thereto are urged toward the closed end 17 of frame 13. Because the opposite ends of the actuation links 39, 39' are constrained to travel in an arc about pivot pins 31, 31' of the opposed arms, the ends of the opposed arms within frame 13 are forced to pivot in a clockwise direction about pivot pins 31, 31'. This action closes the jaw ends 32, 32' around the pipe 51 (See FIG. 1 and 3).

When output shaft 43 is fully retracted, as in FIG. 1, the actuation links 39, 39' and connecting bar 45 are rigidly aligned serving to lock the jaw ends 32, 32' around the pipe. The locking action is achieved due to the centers of pivot points 49, 49' being off-set toward the closed end of frame 13 from a center line drawn between the centers of pivot points 47, 47'. In FIG. 1, the degree of off-set is indicated by the angle $\alpha$ which is greater than zero and preferably about 2–5 degrees.

The pipe gripping head can be proportioned to fit conveniently within the space between adjacent pipes in the rack area, thus allowing pipes to be placed or retrieved from any point within the rack.

While the invention has been shown in only one of its forms, it should be apparent to those skilled in the art that it is not thus limited but is susceptible to various changes and modifications without departing from the spirit thereof.

I claim:

1. A pipe gripping head especially suitable for use with pipe handling apparatus on drilling and workover rigs in the oil industry, said head comprising:

a frame adapted to be secured to pipe handling apparatus;

a pair of opposed pipe gripper arms each being pivotally secured to the frame;

jaw means on one end of each pipe gripper arm to engage and grip a pipe;

an actuation linkage means connected to each arm;

a fluid cylinder carried by the frame and having an output shaft connected to said actuation linkage means to urge said opposed arms from a closed position to an open position;

the actuation linkage means being adapted to mechanically lock the jaw means when in the closed position to prevent accidental opening if pressure decreases in the fluid cylinder.

2. A pipe gripping head especially suitable for use with pipe handling apparatus on drilling and workover rigs in the oil industry, said head comprising:

a frame adapted to be secured to pipe handling apparatus;

a pair of opposed pipe gripper arms each having an intermediate region pivotally secured to the frame;

jaw means on one end of each pipe gripper arm to engage and grip a pipe;

an actuation linkage means connected to each arm at the end opposite from the jaw means;

a fluid cylinder carried by the frame and having an output shaft connected to said actuation linkage means to urge said opposed arms from a closed position to an open position;

the actuation linkage means being adopted to mechanically lock the jaw means when in the closed position to prevent accidental opening if pressure decreases in the fluid cylinder.

3. A pipe gripping head especially suitable for use with pipe handling apparatus on drilling and workover rigs in the oil industry, said head comprising:

a frame adapted to be secured to pipe handling apparatus;

a pair of opposed pipe gripper arms each having an intermediate region pivotally secured to the frame;

jaw means on one end of each pipe gripper arm to engage and grip a pipe;

a pair of actuation links, each having one end pivotally secured to a respective arm at the end opposite the jaw means;

a fluid cylinder carried by the frame and having an output shaft connected to opposed ends of the actuation links to urge the links and attached arms between a closed position and an open position;

the actuation links being adapted to mechanically lock the jaw means when in the closed position to prevent accidental opening if pressure decreases in the fluid cylinder.

4. A pipe gripping head especially suitable for use with pipe handling apparatus on drilling and workover rigs in the oil industry, said head comprising:

a frame adapted to be secured to pipe handling apparatus;

a pair of opposed pipe gripper arms each having an intermediate region pivotally secured to the frame;

jaw means on one end of each pipe gripper arm to engage and grip a pipe;

a pair of actuation links, each having one end pivotally secured to a respective arm at the end opposite the jaw means;

a fluid cylinder carried by the frame and having an output shaft;

a connection bar secured to the output shaft of the fluid cylinder;

the opposed ends of each actuation link being pivotally connected to the connection bar for actuation by movement of the output shaft of the fluid cylinder;

the actuation links and connection bar pivot points being aligned to mechanically lock the jaw means in the closed position to prevent accidental opening if pressure decreases in the fluid cylinder.

5. A pipe gripping head especially suitable for use with pipe handling apparatus on drilling and workover rigs in the oil industry, said head comprising;

a frame adapted to be secured to pipe handling apparatus;

a pair of opposed pipe gripper arms each having an intermediate region pivotally secured to the frame;

jaw means on one end of each pipe gripper arm to engage and grip a pipe;

a pair of actuation links, each having one end pivotally secured to a respective arm at the end opposite the jaw means;

a fluid cylinder having a housing carried by the frame and an output shaft movable between an extended position and retracted position;

a connection bar secured to the output shaft of the fluid cylinder;

the opposed ends of each actuation link being pivotally connected to the connection bar to rigidly align the actuation links and close the jaw means when the cylinder is retracted and to pull the actuation links and arms to open the jaw means when the cylinder is extended.

* * * * *